US010254033B2

(12) United States Patent
Geller

(10) Patent No.: US 10,254,033 B2
(45) Date of Patent: Apr. 9, 2019

(54) ICE CUBE DISPENSING APPARATUS

(71) Applicant: Eric Geller, San Diego, CA (US)

(72) Inventor: Eric Geller, San Diego, CA (US)

( * ) Notice: Subject to any disclaimer, the term of this patent is extended or adjusted under 35 U.S.C. 154(b) by 88 days.

(21) Appl. No.: 15/359,208

(22) Filed: Nov. 22, 2016

(65) Prior Publication Data

US 2017/0159988 A1 Jun. 8, 2017

Related U.S. Application Data

(60) Provisional application No. 62/262,889, filed on Dec. 3, 2015.

(51) Int. Cl.
*F25C 1/24* (2018.01)
*F25C 1/04* (2018.01)

(52) U.S. Cl.
CPC . *F25C 1/24* (2013.01); *F25C 1/04* (2013.01)

(58) Field of Classification Search
CPC ..... F25C 1/24; F25C 1/04
See application file for complete search history.

(56) References Cited

U.S. PATENT DOCUMENTS 2,049,902 A * 8/1936 Fischer ..... F25C 1/24 249/121
2,503,693 A * 4/1950 Van Lennep ..... F25C 1/24 220/345.2
2,594,127 A * 4/1952 Collier ..... F25C 1/24 206/508
3,374,982 A * 3/1968 Sallade ..... F25C 1/24 249/121
4,967,995 A * 11/1990 Burgess ..... F25C 1/24 220/350
5,188,744 A * 2/1993 Silverman ..... F25C 1/243 221/91
5,196,127 A * 3/1993 Solell ..... F25C 1/243 221/91

FOREIGN PATENT DOCUMENTS

EP 0279408 A2 * 2/1988

* cited by examiner

*Primary Examiner* — Emmanuel Duke
(74) *Attorney, Agent, or Firm* — TJSL Patent Clinic

(57) ABSTRACT

An ice cube dispensing apparatus comprises a tray, ice cube compartments, a plurality of brackets, and one or more slidable tray covers allowing a single ice cube compartment to be uncovered at a time. When water or other liquid is added to the ice cube compartments and frozen, the ice cube dispensing apparatus can be turned upside down and the slidable tray covers prevents the frozen liquid from falling out of the slidable tray.

18 Claims, 5 Drawing Sheets

ICE CUBE DISPENSING APPARATUS

CROSS-REFERENCE TO RELATED APPLICATION

The present application claims the benefit of U.S. Provisional Patent Application No. 62/262,889, filed on Dec. 3, 2015, entitled "Ice Cube Dispensing Apparatus," the entire invention of which is incorporated by reference herein.

FIELD OF THE INVENTION

The present invention relates to an ice cube dispensing apparatus, and more specifically, to an ice cube forming apparatus that has multiple sliding lids, allowing a user to remove one or more ice cubes at one time without unwanted release of the rest of the ice cubes.

BACKGROUND

Manually operated ice cube trays are widely used. Such trays are often utilized in freezers as an addition to automated ice makers or as the sole means of producing ice cubes. Typically, such trays are commonly fabricated of metallic materials such as aluminum, stainless steel, etc. Such metallic trays often include individual cube shaped compartments that are filled with water, placed in a freezer and allowed to stand until the water had fully hardened into individual ice cubes. To release the ice cubes, the bottom of such trays might be warmed with, for example, relatively warm water or other sources of heat. Other such trays include extraction devices that enable the walls of each cube-forming compartment to be displaced so as to physically eject the ice cubes. In another example, a simple sheering force might also be utilized to release ice cubes from metal trays by a sharp tapping of the tray with or against a hard object to release the cubes.

Recently, flexible plastic ice trays have been widely utilized to form ice cubes without an automated ice maker. Such trays often contain individual compartments wherein water is placed prior to placing the ice tray in a freezer. When the water in these trays has fully hardened into ice, these trays could be, by virtue of the flexible plastic from which they were made, twisted in order to distort the individual ice cube compartments and eject the ice cubes therefrom. Removing only one or a selected few ice cubes from an ice tray is difficult with both the current metallic and plastic variations.

After releasing ice cubes from either a metallic or plastic ice tray, the resulting ice cubes may, for example, be placed in an ice bucket or open ice bowl to enable the user to serve the ice cubes. To remove the ice cubes form the bowls or buckets, one commonly utilizes a large spoon, tongs, or in some instances, one's fingers. Such methods are problematic, because ice cubes are slippery and are often dropped when a spoon or tong is used to dispense the ice cubes. Removing ice from a container with one's hand is, of course, wrought with dangers related to transmission of bacterial and viral infections and is often shunned by those receiving the ice cubes.

A simple and effective means of removing a selected ice cube(s) from a manually operated tray without disturbing the remaining ice does not exist. There are no disclosures for an effective and efficient means of dispensing individual ice cubes without the use of spoons, tongs, or direct manual dispensing of ice.

For the foregoing reasons, there is a need for an apparatus that allows the manual removal of a selected single or small number of ice cubes.

SUMMARY

The present invention, in its many embodiments, provides an apparatus for removing a selected number of ice cubes at a time from the ice cube tray without the use of any external assistance.

In an exemplary embodiment, the ice cube dispensing apparatus comprises a tray with a top surface, bottom surface, a plurality of ice cube compartments opening on the top surface and protruding from the bottom surface, a plurality of brackets protruding from the top surface of said tray, and a plurality of slidable tray covers attached to the top surface by said plurality of brackets wherein the slidable tray covers can move toward the front end and the back end of the tray to uncover at least one of the ice cube compartments. In another exemplary embodiment, the individual ice cube dispensing apparatus is constructed from a flexible and transparent material to allow the apparatus to be twisted to release the ice cubes from the ice cube compartments and to view the contents of the ice cube compartments.

In another exemplary embodiment, the slidable tray covers are held in place by brackets affixed to the tray so when the device is turned upside down, the slidable tray covers remain in place, which, in turn, prevents the undesired ice cubes from falling out. The slidable tray covers can be removed to expose individual ice cube compartments that will in turn allow for ice cubes within such uncovered ice cube compartments to fall out using gravity. This provides a hygienic means for handling frozen liquid such as ice cubes, while also allowing the user to select the exact number of ice cubes they want removed at a time. In an exemplary embodiment, a slidable tray covers may be either partially or entirely slid off of said tray by the use of the handles. In exemplary embodiments, the handles comprise a grip of about 0.5 inches protruding from both ends of the slidable tray covers.

In another exemplary embodiment, the ice cube dispensing apparatus comprises a plurality of rows of ice cube compartments and a plurality tray covers.

In another exemplary embodiment, the ice cube dispensing apparatus comprises an ice cube compartment and a single slidable tray cover.

In yet another exemplary embodiment, an individual ice cube dispensing apparatus comprises a plurality of ice cube compartments and multiple slidable tray covers.

BRIEF DESCRIPTION OF THE FIGURES

Embodiments of the invention will now be described, by way of example only, with reference to the accompanying figures.

DETAILED DESCRIPTION

Figure 1:
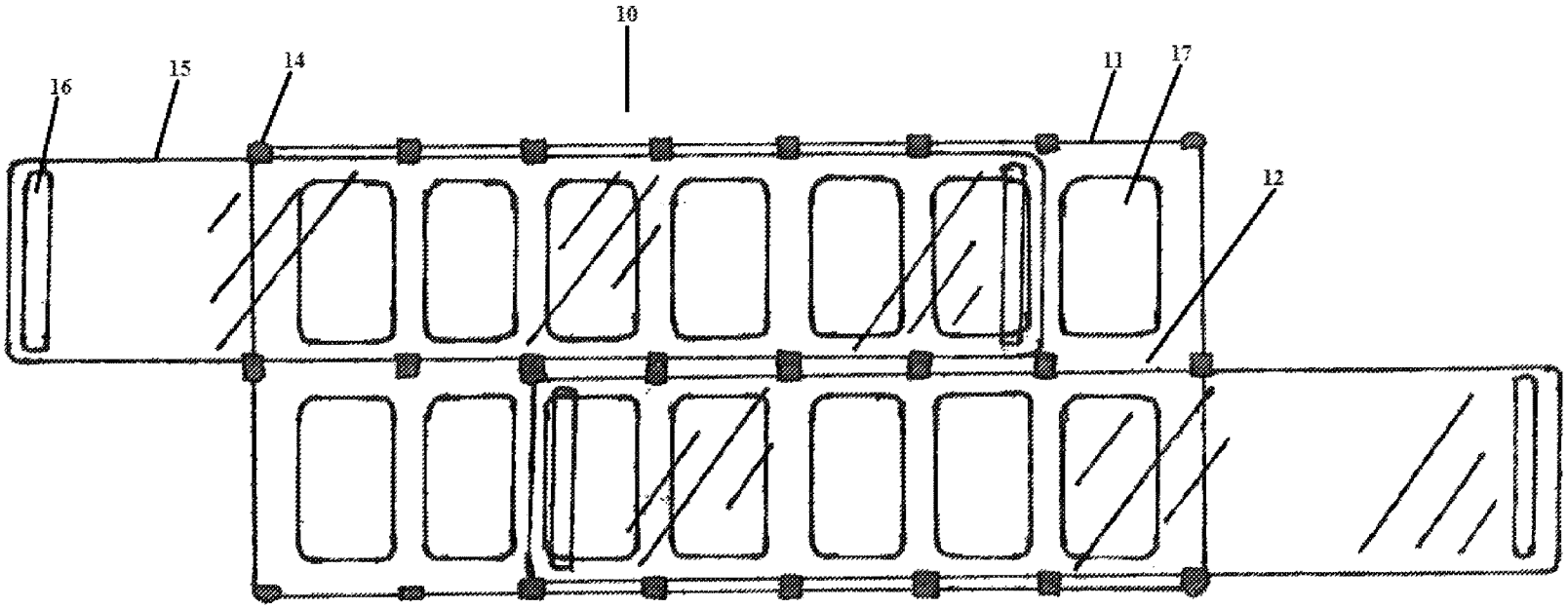
FIG. 1 illustrates a top view of an exemplary embodiment of an individual ice cube dispensing apparatus wherein the slidable tray covers partially open in accordance with the principles of the present invention.

The following detailed description is merely exemplary in nature and does not limit the disclosure or the application and uses of the invention. As used herein, the word "exemplary" means "serving as an example, instance, or illustration." Thus, any embodiment described herein as "exemplary" is not necessarily to be construed as preferred or advantageous over other embodiments. Furthermore, there is no intention to be bound by any expressed or implied theory presented in the preceding technical field, background, brief summary, or the following detailed description.

In this description, reference is made to the figures, wherein like parts are designated with like reference numerals throughout. As used in this disclosure herein and throughout, the meaning of "a," "an," and "said" includes plural reference unless the context clearly dictates otherwise. Also, as used in this disclosure herein, the meaning of "in" includes "into" and "on" unless the context clearly dictates otherwise. As used herein, the term "about" in conjunction with a numeral refers to a range. As used herein, the term "about" in conjunction with a numeral refers to a range of that numeral starting from 10% below the absolute of the numeral to 10% above the absolute of the numeral, inclusive.

Referring now to the figures, one or more exemplary embodiments of an individual ice cube dispensing apparatus comprises a tray with a top surface and a bottom surface, a set of ice cube compartments opening on the top surface and protruding from the bottom surface, a plurality of brackets protruding from the top surface of the tray, and a set of slidable tray covers attached to the top surface by the plurality of brackets wherein the slidable tray covers can move toward the front end and the back end of the tray to uncover at least one of the ice cube compartments. In one exemplary embodiment, the construction material for the individual ice cube dispensing apparatus is a transparent and flexible material. A person of reasonable skill in the art will be readily able to select a suitable construction material for the ice cube dispenser based on the operating conditions and requirements.

FIGS. 1-4 depict exemplary embodiments for an ice cube dispensing apparatus. An ice cube dispensing apparatus 10 a tray 11 with a top surface 12 and a bottom surface 13, a plurality of ice cube compartments 17 opening on the top surface 12 and protruding from the bottom surface 13 of the tray 11, a plurality of brackets 14 protruding from the top surface 12 of the tray 11; and a plurality of slidable tray covers 15 attached to the top surface 12 by a plurality of brackets 14, wherein the slidable tray covers 15 are configured to move toward the front end and the back end of the tray 11 to uncover at least one of the ice cube compartments 17. In another exemplary embodiment the tray 11 comprises a flexible material to allow a user to manipulate the tray 11 to free frozen contents from the ice cube compartments 17. In another exemplary embodiment the tray 11 comprises a transparent material to allow a user to view the frozen contents of the ice cube compartments 17. In another exemplary embodiment the ice cube compartments 17 are arranged in a plurality of rows. In another exemplary embodiment the slidable tray covers 15 comprise a transparent material to allow a user to view the frozen contents of the ice cube compartments 17.

Figure 2:
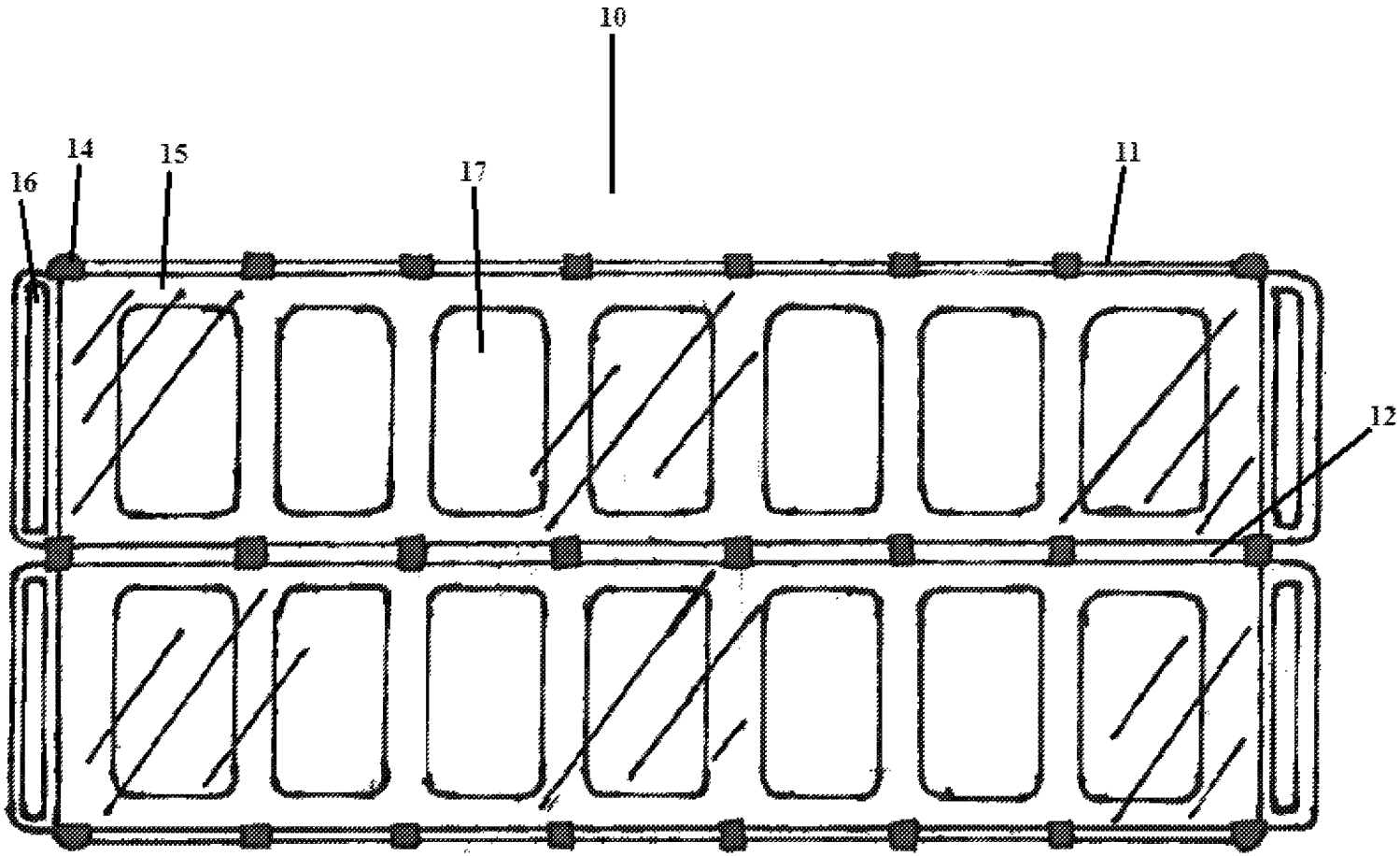
FIG. 2 illustrates a top view of an exemplary embodiment of an individual ice cube dispensing apparatus with the slidable tray covers closed in accordance with the principles of the present invention.
Figure 3:
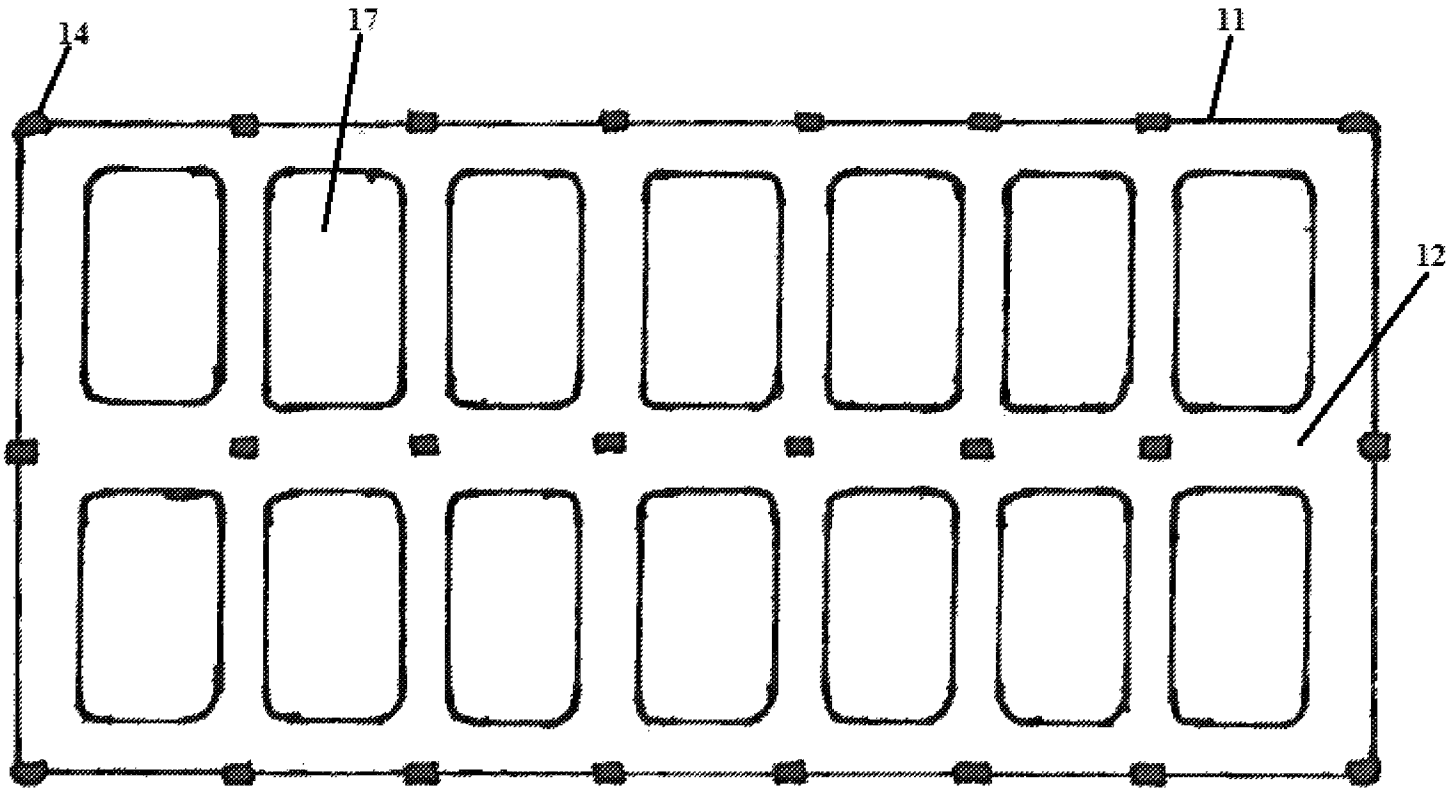
FIG. 3 illustrates a top view of an exemplary embodiment of an individual ice cube dispensing apparatus with the slidable tray covers removed in accordance with the principles of the present invention.
Figure 4:
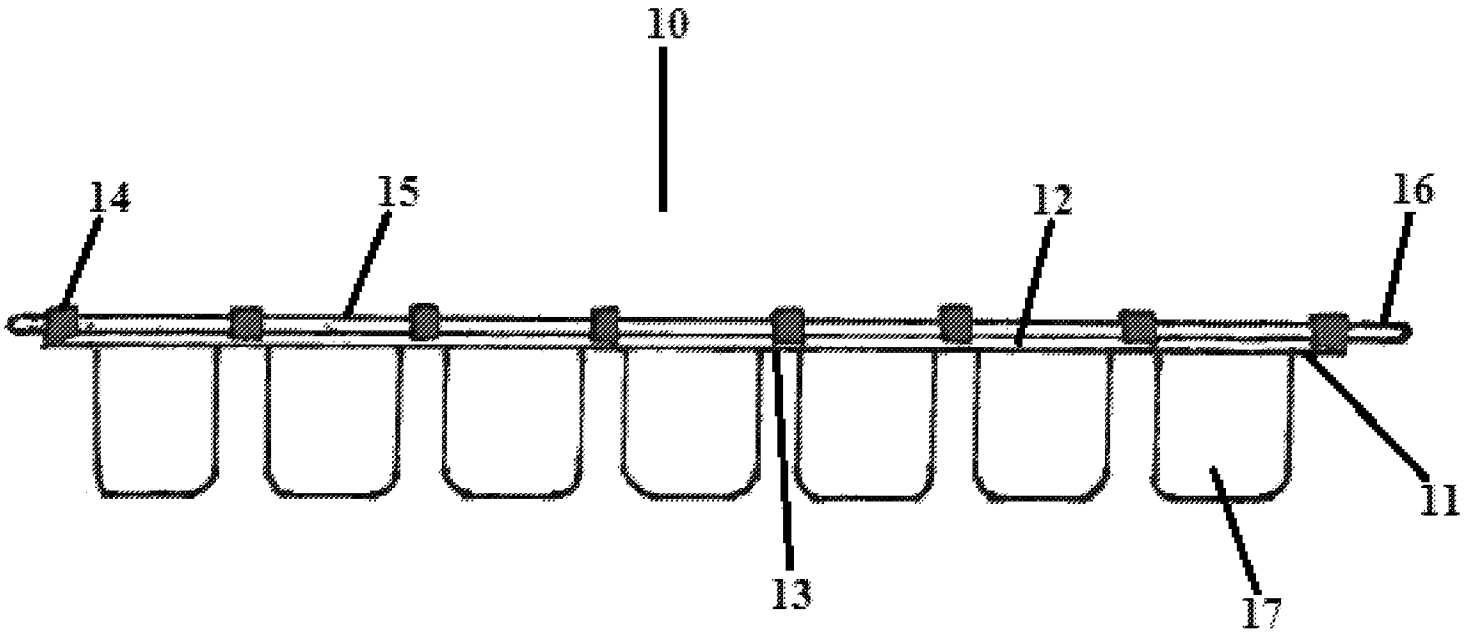
FIG. 4 illustrates a side view of an exemplary embodiment of an individual ice cube dispensing apparatus with the slidable tray covers closed in accordance with the principles of the present invention.

As shown in FIGS. 1-3 the plurality of brackets 14 are located at each corner of each of the ice cube compartments 17.

Figure 5:
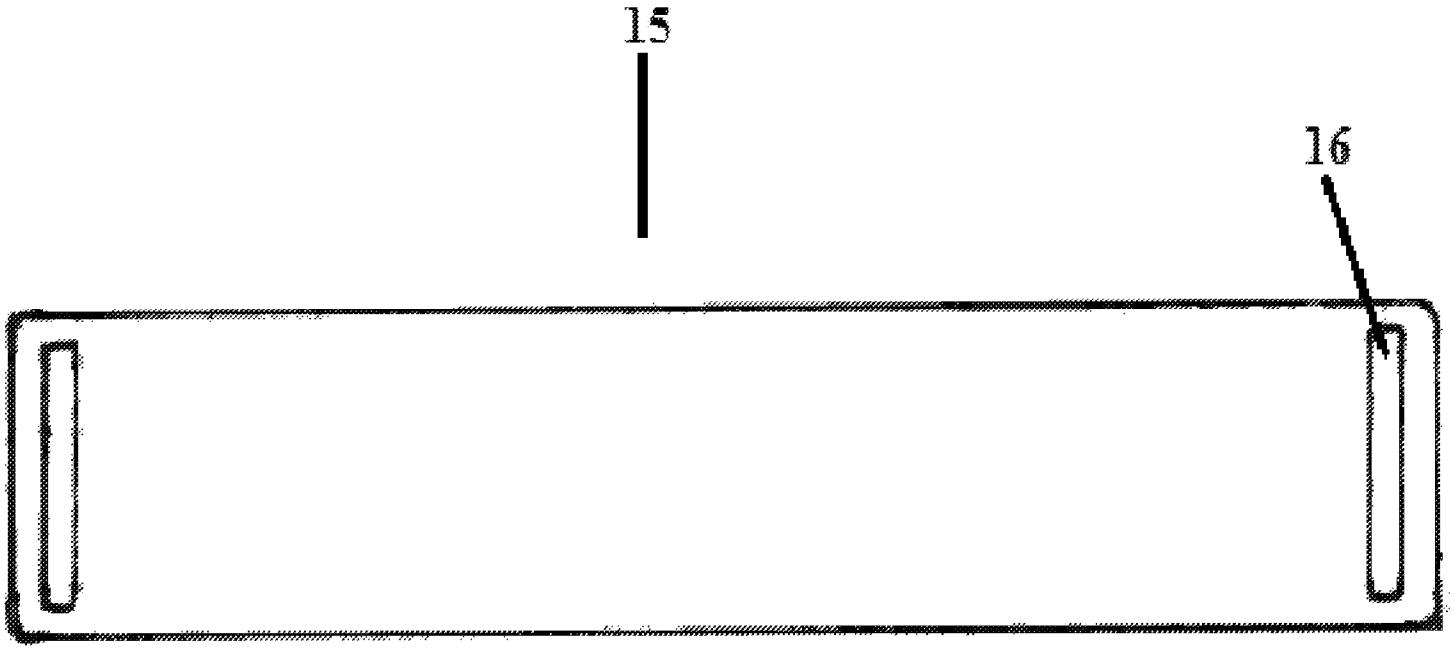
FIG. 5 illustrates a top view of an exemplary embodiment of a slidable tray cover.

As shown in FIGS. 1-2, and 5 the slidable tray covers 15 comprise at least a handle 16. In another exemplary embodiment the slidable tray covers 15 have about 0.5 inches of textured grip protruding from the ends of each handle 16.

Thus, specific embodiments of an ice cube dispensing apparatus and methods to employ such apparatus have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms are interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. An ice cube dispensing apparatus comprising:

a. a tray with a top surface and a bottom surface;

b. a plurality of ice cube compartments opening on said top surface and protruding from said bottom surface of said tray;

c. a plurality of brackets protruding from said top surface of said tray; and d. a plurality of slidable tray covers attached to said top surface by said plurality of brackets, wherein said slidable tray covers are configured to move separately along the top surface of said tray and allow uncovering and removal of ice cubes from all of said ice cube compartments one ice cube at a time.

2. The ice cube dispensing apparatus of claim 1, wherein said tray comprises a flexible material to allow a user to manipulate said tray to free frozen contents from said ice cube compartments.

3. The ice cube dispensing apparatus of claim 1, wherein said tray comprises a transparent material to allow a user to view said frozen contents of said ice cube compartments.

4. The ice cube dispensing apparatus of claim 1, wherein said ice cube compartments are arranged in a plurality of rows.

5. The ice cube dispensing apparatus of claim 1, wherein said plurality of brackets are located at each corner of each said ice cube compartments.

6. The ice cube dispensing apparatus of claim 1, wherein said slidable tray covers are also configured to move simultaneously along the top surface of said tray to uncover two or more of said ice cube compartments at a time.

7. The ice cube dispensing apparatus of claim 1, wherein said slidable tray covers comprise at least a handle.

8. The ice cube dispensing apparatus of claim 7, wherein said slidable tray covers have about 0.5 inches of textured grip protruding from the ends of each said handle.

9. The ice cube dispensing apparatus of claim 1, wherein said slidable tray covers are removable from either side of said tray.

10. The ice cube dispensing apparatus of claim 1, wherein said slidable tray covers comprise a transparent material to allow a user to view frozen contents of said ice cube compartments.

11. The ice cube dispensing apparatus of claim 1, wherein said slidable tray cover is removable from either side of said tray.

12. The ice cube dispensing apparatus of claim 1, wherein said slidable tray cover comprises a transparent material to allow a user to visually inspect frozen contents of said ice cube compartment.

13. An ice cube dispensing apparatus comprising:

a. a tray comprising a top surface and a bottom surface;

b. a plurality of ice cube compartments opening on said top surface and protruding from said bottom surface of said tray;

c. a plurality of brackets protruding from said top surface of said tray; and d. a slidable tray cover attached to said top surface by said plurality of brackets, wherein said slidable tray cover is configured to move along the top surface of said tray and allow uncovering and removal of ice cubes from all of said ice cube compartments one ice cube at a time.

14. The ice cube dispensing apparatus of claim 13, wherein said tray comprises a flexible material to allow a user to manipulate said tray to free frozen contents from said ice cube compartments.

15. The ice cube dispensing apparatus of claim 13, wherein said tray comprises a transparent material to allow a user to visually inspect frozen contents of said ice cube compartments.

16. The ice cube dispensing apparatus of claim 13, wherein said plurality of brackets are located at each corner of said ice cube compartments.

17. The ice cube dispensing apparatus of claim 13, wherein said slidable tray cover comprises at least a handle.

18. The ice cube dispensing apparatus of claim 17, wherein said slidable tray cover has about 0.5 inches of textured grip protruding from the end of each said handle.

* * * * *